US012655713B2

(12) United States Patent
Schneider et al.

(10) Patent No.: US 12,655,713 B2
(45) Date of Patent: Jun. 16, 2026

(54) DORMANT PACKER FRACTURING COMPLETION SYSTEM

(71) Applicant: Schlumberger Technology Corporation, Sugar Land, TX (US)

(72) Inventors: Brandon Lee Schneider, Calgary (CA); Matthew McCarthy, Calgary (CA); Roman Vakulin, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/274,115

(22) Filed: Jul. 18, 2025

(65) Prior Publication Data

US 2026/0022617 A1 Jan. 22, 2026

Related U.S. Application Data

(60) Provisional application No. 63/673,299, filed on Jul. 19, 2024.

(51) Int. Cl.

| | |
|---|---|
| ***E21B 33/128*** | (2006.01) |
| ***E21B 23/00*** | (2006.01) |
| ***E21B 33/129*** | (2006.01) |

(52) U.S. Cl.

CPC ..... *E21B 33/128* (2013.01); *E21B 23/006* (2013.01); *E21B 33/1293* (2013.01); *E21B 2200/08* (2020.05)

(58) Field of Classification Search

CPC .. E21B 33/128; E21B 23/006; E21B 2200/08; E21B 33/1293

See application file for complete search history.

(56) References Cited

U.S. PATENT DOCUMENTS

| | | | | |
|---|---|---|---|---|
| 1,423,213 | A * | 7/1922 | Heeter | E21B 33/128 166/138 |
| 2,182,549 | A * | 12/1939 | Brumbly | E21B 33/1291 166/139 |
| 2,778,430 | A * | 1/1957 | Baker | E21B 33/1291 166/131 |
| 3,064,734 | A * | 11/1962 | Toelke | E21B 33/134 166/63 |
| 3,195,643 | A * | 7/1965 | Harbison | E21B 23/01 417/450 |
| 9,638,003 | B2 | 5/2017 | George | |
| 2008/0169105 | A1* | 7/2008 | Williamson | E21B 33/1294 166/374 |
| 2014/0190685 | A1* | 7/2014 | Frazier | E21B 33/1208 166/135 |
| 2017/0009556 | A1* | 1/2017 | George | E21B 33/12 |
| 2017/0175483 | A1* | 6/2017 | McCarthy | E21B 23/006 |
| 2017/0226820 | A1* | 8/2017 | Leonardi | E21B 19/22 |
| 2018/0038221 | A1* | 2/2018 | Hughes | E21B 47/09 |
| 2019/0264520 | A1* | 8/2019 | Frazier | E21B 33/134 |
| 2020/0032612 | A1* | 1/2020 | Joshi | E21B 43/38 |
| 2021/0381334 | A1* | 12/2021 | Goodman | E21B 33/128 |
| 2022/0205333 | A1* | 6/2022 | McFarlin | E21B 33/124 |

* cited by examiner

*Primary Examiner* — Neel Girish Patel
(74) *Attorney, Agent, or Firm* — Kyle R. Miiller

(57) ABSTRACT

A system and method of utilizing degradable components on a coiled tubing fracturing system to place a packer in a dormant state. Degrading or dissolving the component remove to remove an obstruction in the actuation system. The removal of the obstruction causes a drag collet assembly of the dormant packer to be activated allowing the packer to actuate. The degradable components will dissolve or degrade when exposed to an acid or brine.

10 Claims, 6 Drawing Sheets

DORMANT PACKER FRACTURING COMPLETION SYSTEM

PRIORITY CLAIM/CROSS REFERENCE TO RELATED APPLICATIONS

Patent Document claims priority under 35 U.S.C. § 119 to U.S. Provisional App. Ser. No. 63/673,299, entitled "Improvements for Multilateral Completion Systems", filed on Jul. 19, 2024, which is incorporated herein by reference in its entirety.

BACKGROUND

There are two types of coiled tubing shiftable stimulation operation systems. The first system uses a resettable isolation packer that is set below each target stage during fracturing to create isolation in a wellbore. The second system is a fracture in place system that has no need for isolation and therefore does need an isolation packer. This system is typically referred to as a packerless fracture in place system. When a leak occurs through a sliding sleeve while utilizing the packerless fracture in place system, the coiled tubing BHA will have to be removed and a separate isolation packer has to be inserted into the wellbore. There is a need for a dormant isolation packer in the fracture in place system coiled tubing shiftable system in the event there is a leak in the sliding sleeve.

SUMMARY

The present disclosure relates to systems and methods of utilizing degradable components in a wellbore to actuate a downhole tool, by degrading or dissolving the component in order to acuate the tool. Degrading or dissolving the component removes the obstruction in the actuation system. The invention relates to a system and method of including a dormant isolation packer on a coiled tubing bottom hole assembly (BHA) shifting system that remains dormant with a degrading or dissolving the component.

The invention will have an isolation packer in a dormant state on a coiled tubing shifting tool. The isolation packer will have dissolvable components to help maintain the isolation packer in the dormant state. The system can operate the same as a traditional packerless operation. The packer to be run on the coiled tubing BHA without causing any additional coil movements during regular packerless operation. In the event of a leaking sliding sleeve, a fluid can be pumped downhole to dissolve the dissolvable components. The packer becomes active after the dissolvable components have dissolved. The fluid can include brine, acid or any other known fluid.

In one embodiment, a dormant packer assembly has slips that engage an inner surface of a tubing. The dormant packer has a sealing element that creates a seal between the packer assembly and the tubing. Also, one or more dissolvable components to maintain the isolation packer in the dormant state. The one or more dissolvable components have a collet retainer and a demobilizing sleeve. The collet retainer and the demobilizing sleeve dissolve when contacted by a fluid and the fluid is an acid or brine. Additionally, a collet restrictor surrounding the collet retainer. The collet restrictor has various opening for the fluid to interact with the collet retainer causing the collet retainer to dissolve. Furthermore, the demobilizing sleeve surrounds an indexing mechanism and the indexing mechanism becomes operatable after the demobilizing sleeve is dissolved by the fluid. The indexing mechanism is a J-slot assembly. The dormant packer assembly also has a drag collet assembly with collet fingers. The collet fingers contact the inner surface of the tubing when the drag collet assembly is in an operatable position. Also, the dissolvable collet retainer and the dissolvable demobilizing sleeve have grooves in the other surface to accelerate the degradation by decreasing the surface area.

In another embodiment, a fracture in place system has a shifting tool for moving a sleeve and a dormant packer assembly with one or more dissolvable components to maintain the isolation packer in the dormant state. The one or more dissolvable components has a collet retainer and a demobilizing sleeve. The collet retainer and the demobilizing sleeve dissolve when contacted by fluid. The fluid is an acid or brine. The system has a collet restrictor surrounding the collet retainer and the collet restrictor has various opening for the fluid to contact the collet retainer causing the collet retainer to dissolve. Also, the collet restrictor limits the radial expansion of the collet fingers after the collet retainer has dissolved. Additionally, the demobilizing sleeve surrounds an indexing mechanism and after the demobilizing sleeve is dissolved the indexing mechanism is operatable. Furthermore, the dissolvable collet retainer and the dissolvable demobilizing sleeve have grooves in the other surface to decrease the amount of time needed to dissolve the dissolvable collet retainer and the dissolvable demobilizing sleeve. The dormant packer assembly also has a sealing element and slips that slide along a sloped surface of a cone. The sealing element and slip engage an inner surface of a tubing when the dormant packer assembly is actuated. Last, the system has a coiled tubing for moving the shifting tool and dormant packer system with a wellbore. The coiled tubing is utilized to convey the fluid to the dormant packer system.

In another embodiment, a method for conveying a shifting tool on a coiled tubing in a wellbore. The shifting tool has a packer that remains dormant. The packer has one or more dissolvable components to maintain the isolation packer in the dormant state and the packer becomes operational when the one or more dissolvable components are dissolved by a fluid. Additionally, the dissolvable components are a collet retainer and a demobilizing sleeve, the collet retainer maintains collet fingers in an inoperable state and the demobilizing sleeve packer maintains an indexing mechanism in an inoperable state. Furthermore, the collet fingers engage the inner surface of a tubing when the collet sleeve is dissolved by the fluid, i.e. acid or brine. The components dissolve causes the collet fingers to contact the inner surface of at tubing creating a friction force to hold the packer assembly while the indexing mechanism is actuated by movement of the coiled tubing. The indexing mechanism permits the packer to move between the active position and inactive position by the indexing mechanism when a force is applied to the coiled tubing

DETAILED DESCRIPTION

In the following description, numerous details are set forth to provide an understanding of some embodiments of the present disclosure. However, it will be understood by those of ordinary skill in the art that that embodiments of the present disclosure may be practiced without these details and that numerous variations or modifications from the described embodiments may be possible.

In the specification and appended claims: the terms "connect," "connection," "connected," "in connection with," "connecting," "couple," "coupled," "coupled with," and "coupling" are used to mean "in direct connection with" or "in connection with via another element." As used herein, the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

Figure 1:
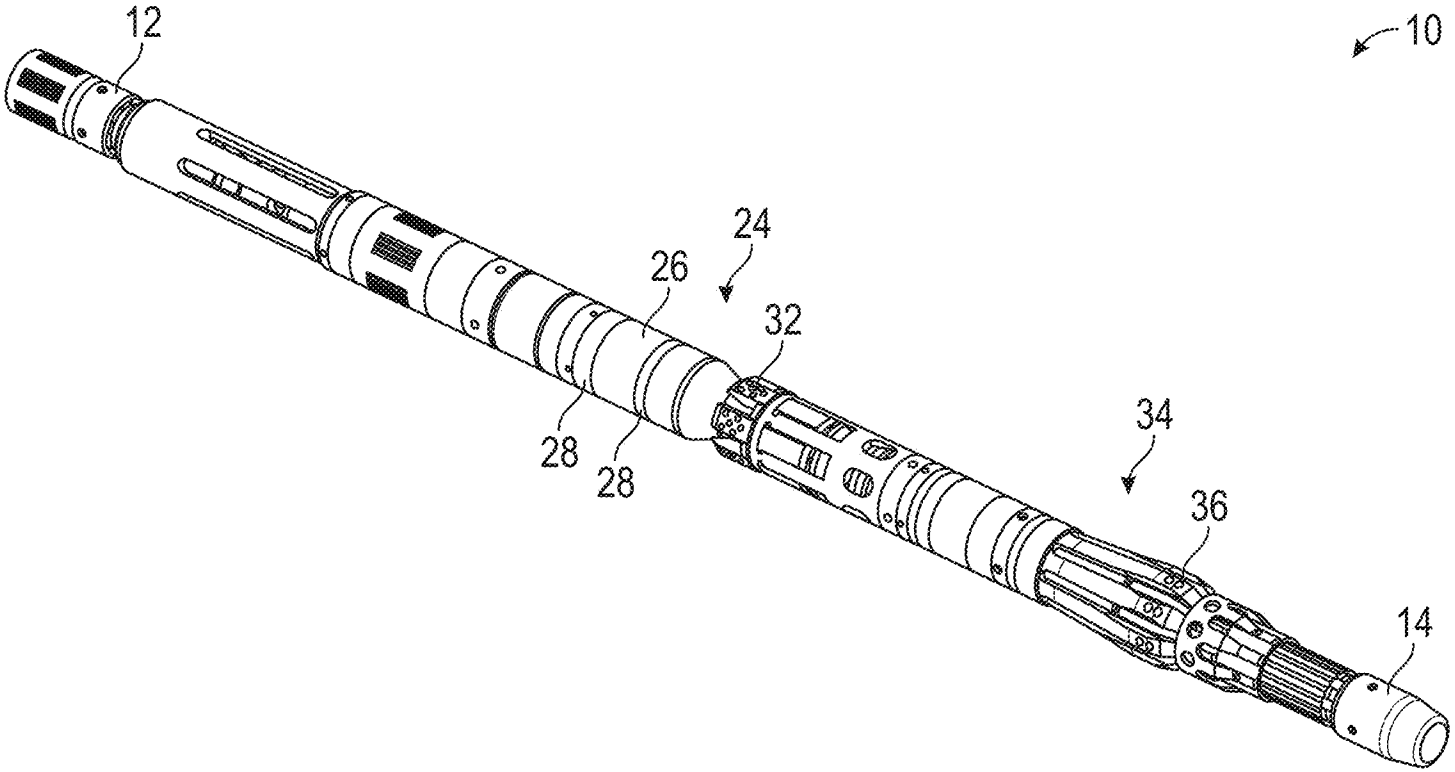
FIG. 1 illustrates a shifting tool with an isolation packer with dissolvable components.
Figure 2:
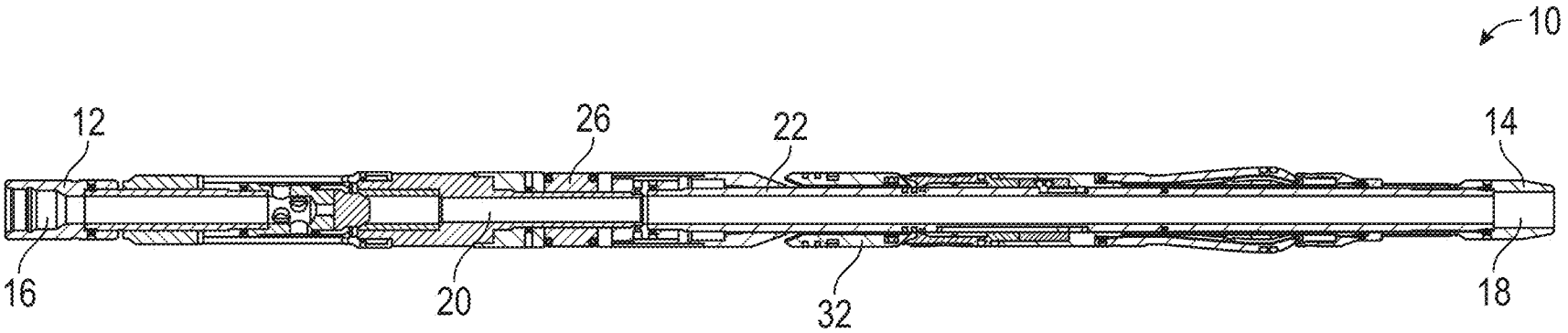
FIG. 2 is a cross sectional view of the isolation packer with dissolvable components.

FIG. 1 is a perspective view of an embodiment of the packer 10 in accordance with the invention. The packer 10 is a dormant isolation packer 10 for a fracture in place system coiled tubing shiftable system. The packer 10 remains dormant until there is a leak in the sleeve or the fracture in place system coiled tubing shiftable system is not functioning properly. Once this occurs, the dormant packer 10 can be actuated and fracturing can be continued with the coiled tubing. In this embodiment, the packer 10 includes multiple components which will be explained in more detail below. The dormant isolation packer 10 has a top sub 12 at the upper end of the packer 10. The top sub 12 can be connected to another downhole tool or a coiled tubing (not shown). The lower end of the packer 10 has a bottom sub 14. The top sub 12 has a bore 16 and bottom sub 14 has a bore 18 forming a continuous bore with a bore 20 of a mandrel 22 of the packer 10 as shown in FIG. 2. The bores of the top sub bore 16, mandrel bore 20 and bottom sub bore 18 align for the passage of tools or fluid.

The dormant packer 10 has a packer assembly 24 that has a packer sealing element 26 and gauge rings 28. The packer sealing element 26 is between an upper gauge ring 28 and a lower gauge ring 28. The gauge rings 28 can also be referred to as end rings. The lower gauge ring is slidable along the mandrel 22 when the packer 10 is actuated. The packer sealing element 26 is a seal made from an elastomeric material. The packer sealing element 26 creates a seal with a surrounding tubing when compressed by a lower slidable gauge ring 28. The packer sealing element 26 is linear squeezed by a gauge ring 28 causing the packer sealing element 26 to expand radially outward into sealing engagement of a surrounding inner surface of a tubing (not shown). The tubing may be a casing, liner or any other surrounding tubular structure. The lower gauge ring is adjacent to a cone 30. The cone 30 surrounds the mandrel 22 and provides a ramped surface for slips 32 to slide along the ramped surface when the packer 10 is actuated. The slips 32 shift radially outward into engagement with a surrounding tubing preventing the packer 10 from movement once set. The ramped surface helps to energize the slips 32 for improved slip bite when pressure is applied.

The packer 10 has a drag collet assembly 34. The drag collet assembly 34 may be positioned below the slips 32 and around the mandrel 22. The drag collet assembly 34 has collet fingers 36. The first end of the collet fingers 36 are coupled to the packer 10 while the second end can flex outward. The second end of the collet fingers 36 are configured to bear against the surrounding tubing, so as to provide friction therewith that resists movement and permits the mandrel 22 to be moved relative thereto. The radially expanded collet fingers 36 will have an outer diameter greater than the inner diameter of the tubing. The second end of each collet finger 36 has a tab 38 extending linearly from the collet fingers 36. The drag collet assembly 34 remains in a dormant position by a dissolvable component within a collet restrictor 40. The dissolvable component is located on the inner surface of the collet restrictor 40. The dissolvable component is known as a dissolvable collet retainer 42. The collet retainer 42 positioned within the collet restrictor 40 maintains the drag collet in a dormant run-in position by overlapping and surround the tabs 38 on the collet fingers 36, as illustrated in FIG. 3.

Figure 3:
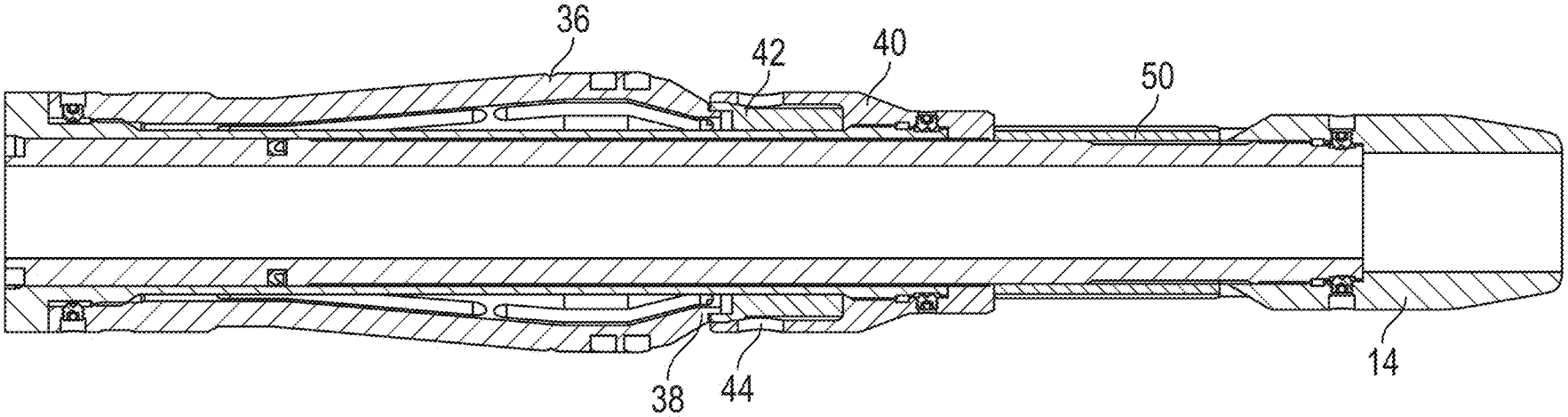
FIG. 3 is a cross section of drag collet assembly in a run in configuration and the dissolvable components that restrict activation of the packer.
Figure 4:
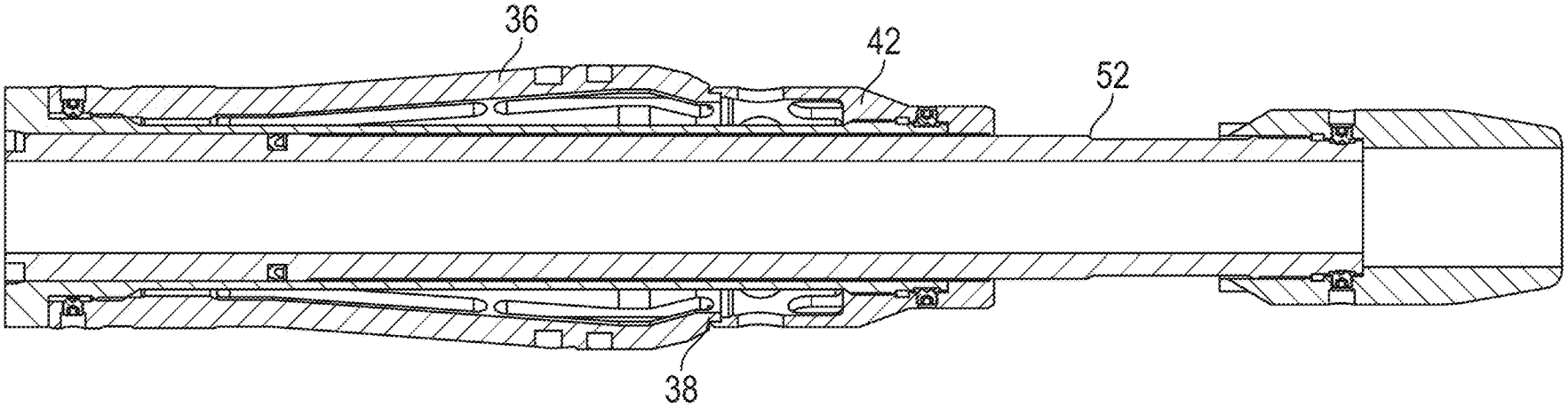
FIG. 4 is a cross section of the drag collet assembly in an actuated configuration without the dissolvable components.
Figure 5:
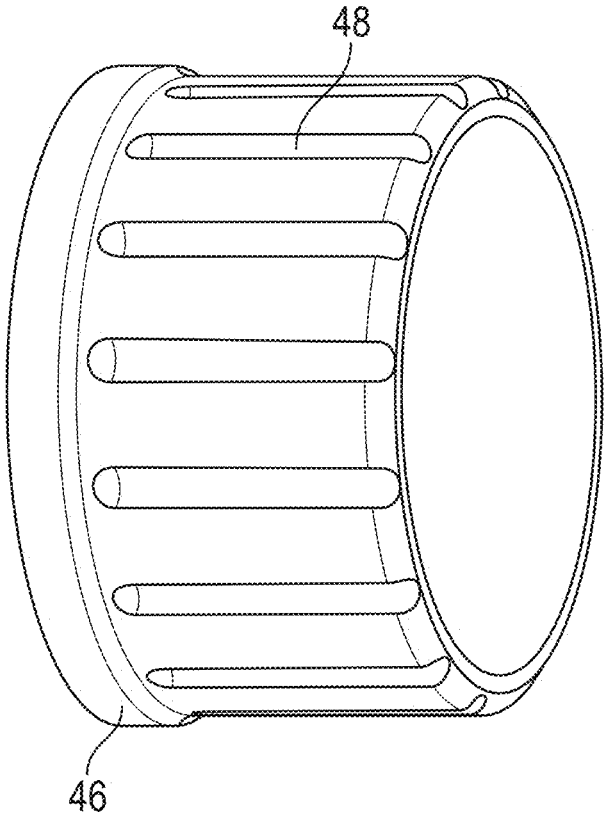
FIG. 5 illustrates a dissolvable demobilizing sleeve.
Figure 6:
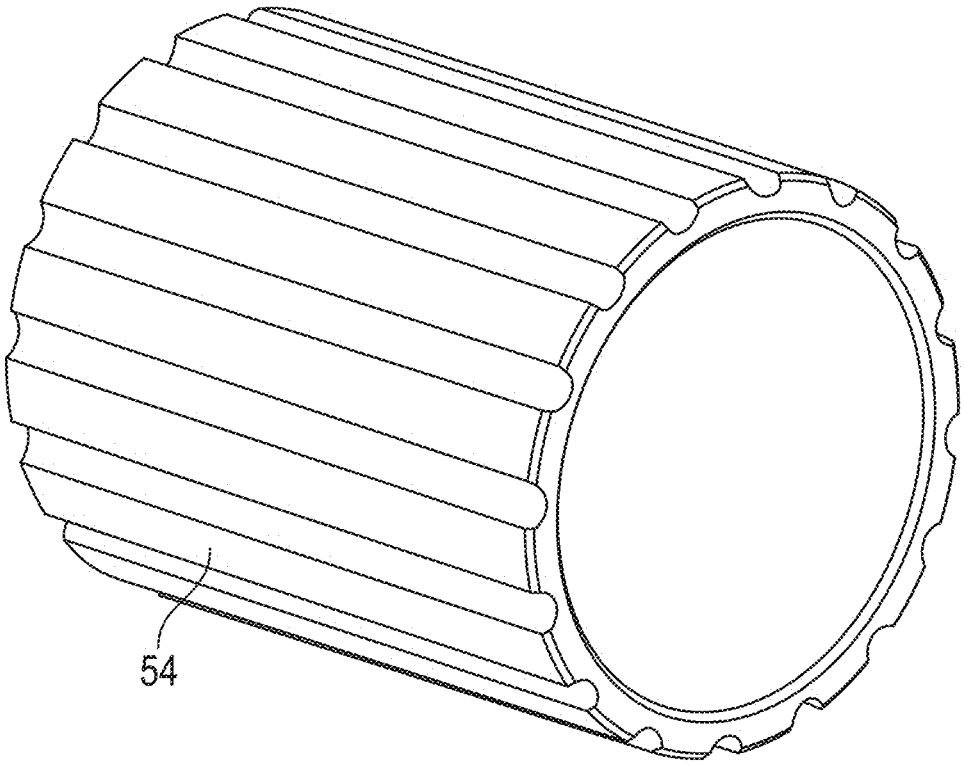
FIG. 6 illustrates a dissolvable collet retainer.
Figure 7:
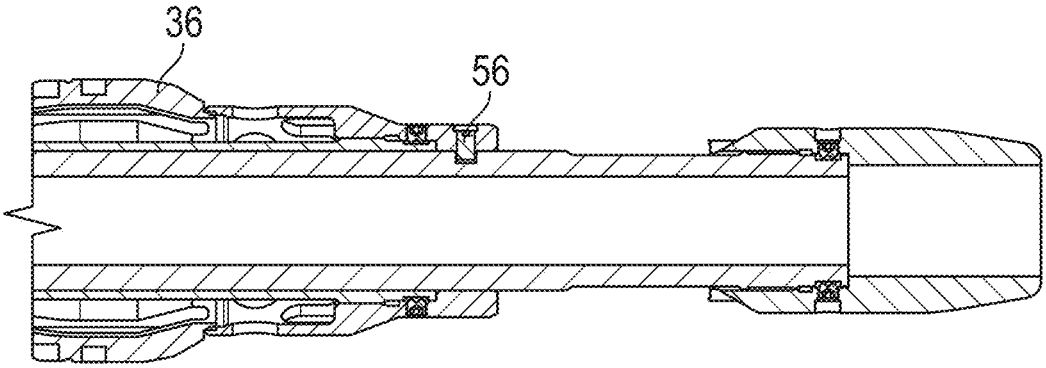
FIG. 7 is a cross section view of another embodiment of the tool with a shear pin instead of the dissolvable components.
Figure 8:
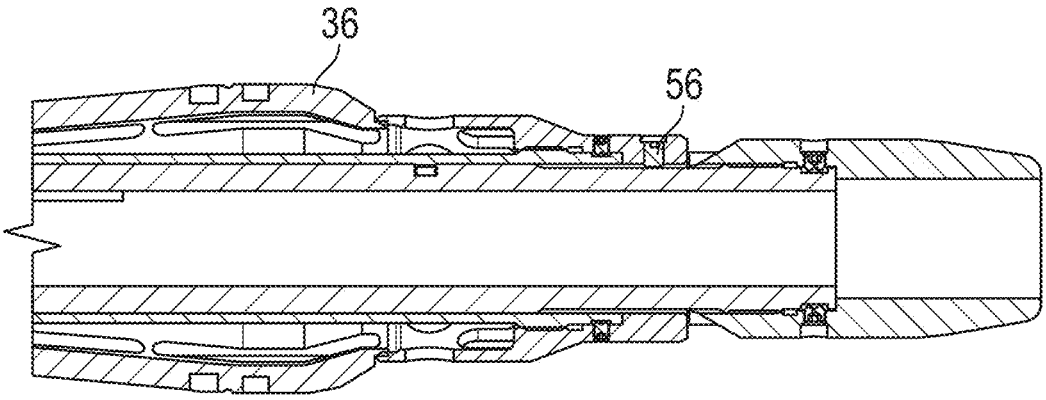
FIG. 8 illustrates the shear pin sheared.

The dissolvable collet retainer 42 and collet restrictor 40 surround the linearly extending tab 38 of each of the collet fingers 36 preventing the collet fingers 36 from flexing outward as shown in FIG. 3. The collet restrictor 40 has various openings 44 allowing fluid to enter the inner surface of the collet restrictor 40. The fluid entering the various openings 44 can dissolve the dissolvable collet retainer 42. The dissolvable collet retainer 42 is a tubular sleeve with a first end and a second end. The first end has a flange 46 that overlaps the tab 38 of the collet finger 36, as illustrated in FIG. 3. The second end of dissolvable collet retainer 42 has grooves 48 on the outer surface as shown in FIG. 6. The grooves 48 extend from the second end to the flange 46. The grooves 48 help speed up the degradation of the dissolvable component.

Adjacent the downhole end of the collet restrictor 40 is a second dissolvable component known as a demobilizing sleeve 50. The dissolvable demobilizing sleeve 50 acts as an anti-preset device. The dissolvable demobilizing sleeve 50 prevents the packer 10 from actuating. The demobilizing sleeve 50 surrounds an indexing mechanism 52. The indexing mechanism 52 may be a J-slot. The indexing mechanism 52 is used in cooperation with pushing (compression) and pulling (tension) applied to the coiled tubing to actuate the dormant packer 10. The packer 10 and indexing mechanism 52 may by mechanically controlled by uphole and downhole force or movement of the coiled tubing allowing the packer 10 to be set multiple times during the fracturing operations. The dissolvable demobilizing sleeve 50 is a tubular sleeve surrounding the mandrel 22 between the collet restrictor 40 and the bottom sub 14. The dissolvable demobilizing sleeve 50 has grooves 54 in the surface for the purpose of speeding up the degradation of the dissolvable demobilizing sleeve 50.

The dissolvable collet retainer 42 and the dissolvable demobilizing sleeve 50 can be made of a material that dissolves or degrades when exposed to a selected fluid. The selected fluid will flow through the coiled tubing from the surface contacting the dissolvable collet retainer 42 and the dissolvable demobilizing sleeve 50. The selective fluids may be liquid, gas, or both. The selected fluid is an acid or brine. The degradation of the materials may be activated by contact with selected fluids. The material may be a polymeric material or a reactive material.

In operation, the dormant isolation packer 10 for a fracture in place system coiled tubing shiftable system is run downhole into a wellbore. An event occurs in which the dormant isolation packer 10 needs to be activated. An activation fluid such as an acid or brine is pumped downhole. The activation fluid with interact with the dissolvable components. The activation fluid will cause the dissolvable collet retainer 42 and the dissolvable demobilizing sleeve 50 to dissolve or degrade. Once the dissolvable collet retainer 42 is dissolved or degraded enough for activation the collet fingers 36 will extend and the tab 38 of the collet finger will contact the collet restrictor 40 restricting the radial expansion of the fingers. As stated before, the collet restrictor 40 will limit the expansion of the collet fingers 36, nonetheless the collet fingers 36 will still contact the inner surface of the tubing creating friction. The friction created by the collet fingers 36 will allow movement of the mandrel 22 by the coiled tubing once the dissolvable demobilizing sleeve 50 has dissolved or degraded. The movement of the coiled tubing will activate the indexing mechanism 52. The indexing mechanism 52 can be a J-slot and movement of the coiled tubing will cause a key to move through the slot of the indexer. The indexing mechanism 52 permits the packer 10 to move through three positions: (i) a run in hole (RIH) position, (ii) active position and (iii) inactive position. The packer 10 can alternate between the active position and inactive position by the indexing mechanism 52. Once the indexing mechanism 52 is activated a force can be applied to actuate the dormant packer 10 on the coiled tubing shiftable system causing the slips 32 to grip the inner surface of the liner and create a seal in the annulus between the packer 10 and the liner.

In a second embodiment, which is similar to the first embodiment. The dissolvable collet retainer 42 and the dissolvable demobilizing sleeve 50 are replaced with a shear pin 56. In this embodiment, the packer assembly 24 is the same. The drag collet assembly 34 is run in hole in an active position. The packer 10 is not actuated and the collet fingers 36 on the drag collet assembly 34 are not dormant. The packer but has a shear pin 56 which functions as an anti-preset mechanism. The shear pin 56 is sheared by a mechanical force applied to the packer 10 by the coiled tubing. Once the shear pin 56 is sheared the indexing mechanism 52 and drag collet can be operated to actuate the packer 10 in the same way described above in the first embodiment.

In operation, the coiled tubing is conveyed downhole for normal fracture in place operations. When an event occurs that requires the use of the packer 10 for fracturing, the packer 10 can be actuated. The actuation occurs by conveying the packer 10 downhole by the coiled tubing until the bottom sub 14 contacts a restriction (not shown). A force can be applied to the bottom sub 14 by the coiled tubing causing the shear pin 56 to shear. As stated before, the drag collet is expanded and active when the packer 10 is conveyed downhole. Once the shear pin 56 is sheared the indexing mechanism 52 can be manipulated by a pulling or pushing force applied by the coiled tubing. The friction caused by the drag collet will cause the indexer mechanism to activate causing the packer 10 to actuate. The actuation of the packer 10 will cause the packer sealing element 26 and slips 32 to engage with the inner surface of the tubing.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A dormant packer assembly comprising:

slips configured to engage an inner surface of a tubing;

a sealing element configured to create a seal between the dormant packer assembly and the tubing;

one or more dissolvable components configured to maintain the dormant packer assembly in a dormant state, wherein the one or more dissolvable components comprise a collet retainer and a demobilizing sleeve, wherein the collet retainer and the demobilizing sleeve are configured to dissolve when contacted by a fluid, and wherein the fluid is an acid or a brine; and a collet restrictor surrounding the collet retainer, wherein the collet restrictor has one or more openings for the fluid to interact with the collet retainer to cause the collet retainer to dissolve.

2. The dormant packer assembly of claim 1, further comprising an indexing mechanism, wherein the demobilizing sleeve surrounds the indexing mechanism, and wherein the indexing mechanism is configured to become operatable after the demobilizing sleeve is dissolved by the fluid.

3. The dormant packer assembly of claim 2, wherein the indexing mechanism is a J-slot assembly.

4. The dormant packer assembly of claim 1, further comprising a drag collet assembly with collet fingers, wherein the collet fingers are configured to contact the inner surface of the tubing when the drag collet assembly is in an operatable position.

5. The dormant packer assembly of claim 1, wherein the collet retainer and the demobilizing sleeve have grooves configured to accelerate degradation by decreasing surface area.

6. A fracture in place system comprising:

a shifting tool configured for moving a sleeve; and a dormant packer assembly comprising:

slips configured to engage an inner surface of a tubing;

a sealing element configured to create a seal between the dormant packer assembly and the tubing;

one or more dissolvable components configured to maintain the dormant packer assembly in a dormant state, wherein the one or more dissolvable components comprise a collet retainer and a demobilizing sleeve, wherein the collet retainer and the demobilizing sleeve are configured to dissolve when contacted by a fluid, and wherein the fluid is an acid or a brine; and a collet restrictor surrounding the collet retainer, wherein the collet restrictor has one or more openings for the fluid to interact with the collet retainer to cause the collet retainer to dissolve.

7. The system of claim 6, wherein the collet restrictor is configured to limit a radial expansion of collet fingers after the collet retainer has dissolved.

8. The system of claim 6, wherein the dormant packer assembly comprises an indexing mechanism, and wherein the demobilizing sleeve surrounds the indexing mechanism, and after the demobilizing sleeve is dissolved, the indexing mechanism is operatable.

9. The system of claim 6, wherein the collet retainer and the demobilizing sleeve have grooves configured to decrease an amount of time needed to dissolve the collet retainer and the demobilizing sleeve.

10. The system of claim 6, further comprising a coiled tubing configured for moving the shifting tool and the dormant packer assembly in a wellbore, wherein the coiled tubing is utilized to convey the fluid to the dormant packer assembly.

* * * * *